US010697184B2

(12) United States Patent
De Rick

(10) Patent No.: US 10,697,184 B2
(45) Date of Patent: Jun. 30, 2020

(54) FLOOR PANEL FOR FORMING A FLOOR COVERING

(71) Applicant: FLOORING INDUSTRIES LIMITED, SARL, Bertrange (LU)

(72) Inventor: Jan De Rick, Geraardsbergen (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

(21) Appl. No.: 16/100,436

(22) Filed: Aug. 10, 2018

(65) Prior Publication Data

US 2019/0063077 A1 Feb. 28, 2019

Related U.S. Application Data

(60) Provisional application No. 62/549,109, filed on Aug. 23, 2017.

(51) Int. Cl.
*E04F 15/02* (2006.01)
*E04F 15/04* (2006.01)

(52) U.S. Cl.
CPC ..... *E04F 15/02038* (2013.01); *E04F 15/04* (2013.01); *E04F 2201/013* (2013.01); *E04F 2201/0153* (2013.01); *E04F 2201/042* (2013.01); *E04F 2201/043* (2013.01)

(58) Field of Classification Search
CPC ..... E04F 15/02038; E04F 2201/0161; E04F 2201/0153; E04F 2201/013
See application file for complete search history.

(56) References Cited

U.S. PATENT DOCUMENTS

| | | | | |
|---|---|---|---|---|
| 7,762,036 | B2 | 7/2010 | Li et al. | |
| 2002/0007609 | A1* | 1/2002 | Pervan | E04F 15/02 52/590.2 |
| 2002/0020127 | A1* | 2/2002 | Thiers | E04F 15/02 52/403.1 |
| 2002/0046528 | A1* | 4/2002 | Pervan | E04F 15/02 52/588.1 |
| 2006/0260254 | A1* | 11/2006 | Pervan | E04F 15/02 52/592.1 |
| 2014/0352248 | A1* | 12/2014 | Whispell | E04F 15/02 52/589.1 |
| 2015/0233127 | A1* | 8/2015 | Dohring | E04F 15/02183 52/177 |

FOREIGN PATENT DOCUMENTS

| | | | | |
|---|---|---|---|---|
| WO | 9747834 | A1 | 12/1997 | |
| WO | WO-9747834 | A1 * | 12/1997 | B27F 1/06 |
| WO | WO-2016207251 | A1 * | 12/2016 | E04F 15/02038 |
| WO | WO-2017108124 | A1 * | 6/2017 | B32B 27/00 |

* cited by examiner

*Primary Examiner* — Christine T Cajilig
(74) *Attorney, Agent, or Firm* — Workman Nydegger

(57) ABSTRACT

A floor panel comprises coupling parts in the form of a tongue and groove connection with locking elements; wherein the groove is bordered by an upper lip and a lower lip; and wherein the one locking element is provided on the lower side of the tongue and the other locking element is provided on the upper side of the lower lip; characterized in that the most upward-situated point of the locking element on the lower lip is situated at a distance of at least ⅓ times the thickness of the floor panel from the underside of the floor panel; and that the minimum thickness of the lower lip is maximum ¼ times the thickness of the floor panel.

17 Claims, 2 Drawing Sheets

FLOOR PANEL FOR FORMING A FLOOR COVERING

BACKGROUND OF THE INVENTION

Field of the Invention

The present invention relates to a floor panel for forming a floor covering.

More particularly, the invention relates to a floor panel of the type as defined in the preamble of claim 1.

Such floor panel is known from document WO 97/47834. In a number of embodiments (See, for example, FIGS. 2-4 and 22-25), the coupling parts are configured such that they allow coupling the panels by means of a turning movement. Herein, the lower lip protrudes beyond the free end of the upper lip, however, the portion protruding beyond the upper lip is not longer than one time the thickness of the floor panel. This should have to lead to a smooth installation of the panels, as well as to a good mechanical locking. However, the inventor has found that applying these coupling parts, as shown in FIGS. 2-4 and 22-25 of WO 97/47834, with relative thick panels does not always result in panels allowing a smooth connection.

SUMMARY OF THE DISCLOSURE

An aim of the invention is to provide floor panels which allow a smoother installation.

This aim is achieved by the floor panel as defined in claim 1, wherein the most upward-situated point of the locking element on the lower lip is situated at a distance, as measured according to the direction perpendicular to the plane of the floor panel, of at least ⅓ times the thickness of the floor panel from the underside of the floor panel and the minimum thickness of the lower lip is maximum ¼ times the thickness of the floor panel, wherein the lower lip reaches its minimum thickness between the free end of the upper lip and the locking element at the lower lip. The combination of these characteristics provides for that the turning movement of the panels in mutual respect can be performed extremely smooth.

Preferred embodiments are defined in the dependent claims 2 to 14.

The invention is applied most advantageously with panels having a thickness of at least 9 millimeters, preferably with panels having a thickness situated between 9 and 15 millimeters.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF PREFERRED EMBODIMENTS OF THE INVENTION

Figure 1:
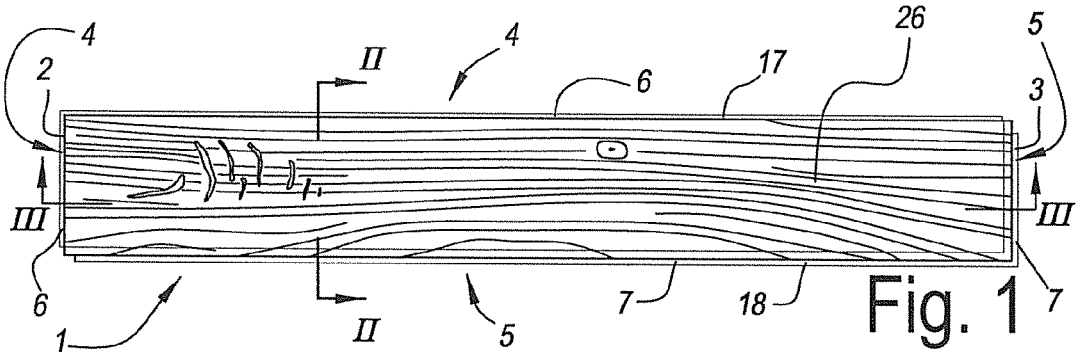
FIG. 1 in top view represents a floor panel according to the invention.

FIG. 1 shows a rectangular floor panel 1 with a pair of opposite long edges 17-18 and a pair of opposite short edges 2-3. Other geometrical shapes are possible as well. So, it is conceivable that the panel is square and the one pair of opposite edges thus has the same length as the other pair of opposite edges.

The floor panel 1 shows a decor on the upper side thereof, here specifically a wood decor 26. Other decors, such as a stone or fantasy decor, are possible as well.

The long edges 17-18 are provided with coupling parts 4-5. The coupling parts 4-5 allow coupling this panel to another such panel. The short edges 2-3 are also provided with coupling parts 4-5, which allow a coupling with another panel. However, this is not absolutely necessary: it is not necessary that both the long and the short edges are provided with coupling parts. However, if this is the case, it is possible that the coupling parts on the one pair of edges are made identical to the coupling parts of the other pair, but this is not necessary at all. It is also possible that the coupling parts of both pairs of edges show the characteristics of the invention, however, again this is not essential. However, in fact it is so that with a rectangular panel the characteristics of the invention preferably are applied at least at the short edges. The reason for this will be explained further in this text.

Figure 2:
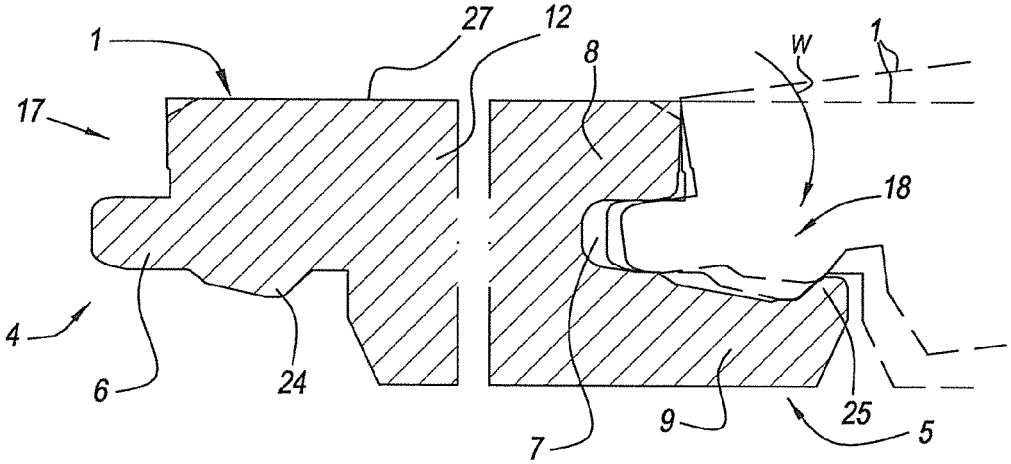
FIG. 2 represents a cross-section according to line II-II in FIG. 1.

FIG. 2 shows the coupling parts 4-5 on the long edges 17-18. The coupling part 4 is realized in the form of a tongue 6 and the coupling part 5 in the form of a groove 7. The coupling parts 4-5 thus form a tongue and groove connection. The groove 7 is bordered by an upper lip 8 and a lower lip 9.

The lower lip 9 of the groove 7 protrudes beyond the free end of the upper lip 8 of the groove 7. This offers the advantage of a smoother coupling movement. However, it is possible that the lower lip 9 has the same length as the upper lip 8 or is even shorter.

The coupling parts 4-5 comprise locking elements 24-25. They are situated on the lower side of the tongue 6 and the upper side of the lower lip 9 of the groove 7, respectively. However, it is not excluded that these elements are situated on another location, such as, for example, on the upper side of the tongue and the lower side of the upper lip, respectively.

The coupling parts 4-5 effect a locking in the direction V (the vertical locking) as well as the direction H (the horizontal locking). The vertical locking is obtained by the cooperation between the upper side of the tongue 6 and the lower side of the upper lip 8. The horizontal locking is realized by the locking elements 24-25, which counteract the moving apart of the tongue 6 and the groove 7 in the direction H.

The coupling parts 4-5, including the locking elements 24-25, are realized from the material of the floor panel 1 and in one piece therewith. Typically, to this aim cutting or milling instruments are used.

The coupling parts 4-5 are formed such that they allow coupling the panels by means of a turning movement. The turning movement is illustrated in FIG. 2 by arrow W. The turning movement W brings the locking elements 24-25 one behind the other.

Figure 3:
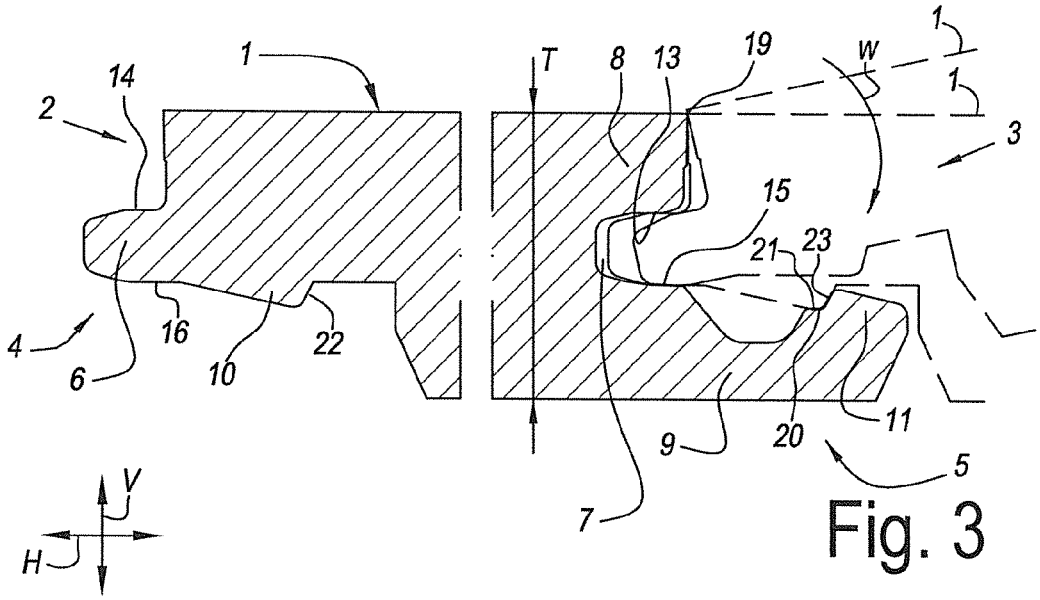
FIG. 3 represents a cross-section according to line in FIG. 1.

FIG. 3 shows the coupling parts 4-5 at the short edges 2-3. The coupling parts 4-5 are realized in the form of a tongue and groove connection and thus comprise a tongue 6 and a groove 7. The groove 7 is bordered by an upper lip 8 and a lower lip 9. The coupling parts 4-5 comprise locking elements 10-11, which are situated on the lower side of the tongue 6 and the upper side of the lower lip 9, respectively. The locking element is situated beyond the free end of the upper lip 8.

The coupling parts 4-5 realize a vertical as well as a horizontal locking. The vertical locking is effected by the cooperating locking surfaces 13-14, which are situated at the lower side of the upper lip 8 and the upper side of the tongue 6, respectively. The horizontal locking is obtained by the cooperating locking elements 10-11 and horizontally active locking surfaces 22-23.

The coupling parts 4-5, including the locking elements 10-11, the vertically active locking surfaces 13-14-15-16 and the horizontally active locking surfaces 22-23, are realized from the material of the floor panel and in one piece therewith. Typically, cutting or milling tools are applied for this purpose.

The coupling parts 4-5 are configured such that they allow coupling the panels by means of a turning movement W. During turning, a click or snap effect can occur, which is the case in FIG. 3. The click or snap effect manifests itself in that the lower lip 9 elastically deforms or bends during coupling, such that the groove opening is enlarged, and later springs back. It is clear that with such turning-snap-movement a resistance has to be overcome in order to be able to couple the panels.

The coupling parts 4-5 can be made with a pretension, which means that in the coupled condition a tension force is provided by the coupling parts which presses the upper edges of the panels towards each other. In this manner, gap formation is counteracted. The tension force is realized, for example, by a lower lip which is bent in the coupled condition, which presses the upper edges of the panels towards each other, as known as such from WO 97/47834 (See FIG. 23 and the pertaining description).

Figure 4:
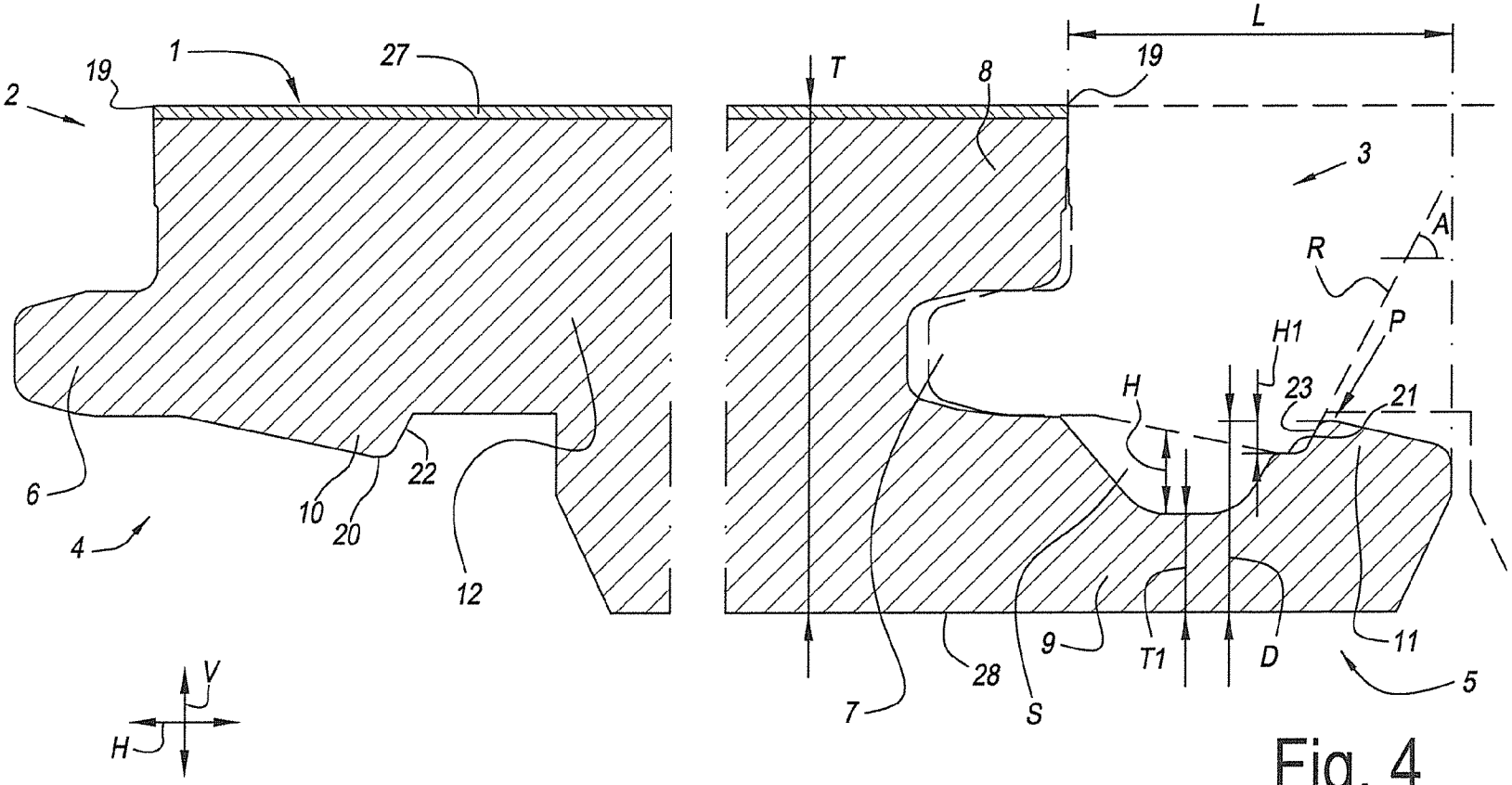
FIG. 4 is an enlarged representation of FIG. 2 and illustrates the present invention in the best manner.

FIG. 4 shows an enlarged rendition of the coupling parts 4-5 on the short edges 2-3.

The lower lip 9 is made relatively short: the lower lip 9 protrudes beyond the free end of the upper lip 8 only over a portion L smaller than the thickness T of the panel 1. Such lower lip allows economizing material in that, for forming the groove, less material has to be removed than in the case of a lower lip which is made longer.

The locking surfaces 22-23 define a tangent line R which forms an angle A with the horizontal, said angle being called the locking angle. The locking angle A preferably is situated between 45 and 90 degrees and more particularly between 50 and 75 degrees. In FIG. 4, the locking angle A is approximately 63 degrees. This offers the advantage of a strong horizontal locking.

The most upward-situated point P of the locking element 11 is situated at a distance D from the underside 28 of the panel 1. The distance D is at least ⅓ times the thickness T of the panel 1. This offers the advantage that, even with a large locking angle A and short lower lip 9, the turning movement is performed in a smooth manner. In this case, namely, the resistance which has to be overcome is minimum, as the inventor found.

As a result, the locking element 11 is made relatively thick. However, this has little or no negative influence on the flexibility of the lower lip 9, in that the minimum thickness T1 of the lower lip 9, obtained between the free end of the upper lip 8 and the locking element 11, is maximum ¼ times the thickness T of the floor panel 1. In FIG. 4, the minimum thickness T1 is approximately ⅕ of the thickness T of the floor panel 1. The inventor has found that such lip 9, in combination with the locking element 11 being realized relatively high, results in an extremely smooth installation of the panels.

The invention is particularly advantageous in the case that pretension is applied in the coupling parts, as the flexible design of the lower lip provides for that this latter remains bent without thereby creating a considerable risk of breakage in the coupling part. Typically, with rectangular panels pretension is applied at the short edges, or a larger pretension is applied than on the long edges. Therefore, the invention in particular, however, not exclusively, is useful on the short edges.

A space S is formed between the upper surface of the lower lip 9 and the lower side of the tongue 6. In FIG. 4, the space S essentially is created by the hollowed portion in the upper side of the lower lip 9, which creates the minimum thickness T1.

The space S has a maximum height H, which is larger than the height H1 over which the locking surfaces 22-23 are extending. The maximum height H is larger than 0.1 times the thickness T of the panel 1. The maximum height H is situated between 0.75 and 1.5 times the minimum thickness T1 of the lower lip 9.

The coupling parts 4-5 comprise support portions 20-21, which cause a fixation in the mutual position of the locking elements 10-11, as described, for example, in U.S. Pat. No. 7,762,036. The support portions 20-21 are situated immediately or directly next to the locking surfaces 22-23, namely without intermediary space, however, this is not necessarily the case. In respect to the panel 1 with the groove 7, the support portions 20-21 are situated proximally from the locking surfaces 22-23. However, it is not excluded that the support portions 20-21 are situated distally from the locking surfaces 22-23, for example, on top of the locking element 11.

The invention is applied most advantageously with relatively thick panels, for example, panels having a thickness T between 9 and 15 millimeters.

The floor panel 1 is a laminate panel which comprises an MDF/HDF core 12 and a decorative top layer 27. The top layer 27 comprises one or more paper layers impregnated with resin, amongst which a printed paper, which in the example is printed with a wood decor 26. Often, such laminate panel also comprises a—not represented—counter layer at the underside of the core 12 in order to provide for the stability of the panel. In such laminate panels, the counter layer typically comprises one or more paper layers impregnated with resin.

Other materials than those described herein above for the core and/or the top layer can be applied within the scope of the invention.

The invention also relates to embodiments as defined in the following items:

The first item relates to a floor panel (1) for forming a floor covering, comprising a first edge (2) with a first coupling part (4) and a second, opposite edge (3) with a second coupling part (5), wherein the aforementioned coupling parts (4-5) are configured such that they allow coupling two of such floor panels to each other and thus realizing a coupled condition on the respective edge; wherein the first coupling part (4) is realized in the form of a tongue (6) and the second coupling part (5) is realized in the form of a groove (7), wherein said groove (7) is bordered by an upper lip (8) and a lower lip (9), wherein said tongue and groove, in coupled condition, form a tongue and groove connection which, at the respective edge, forms a locking between the coupled panels in a first direction (V) perpendicular to the plane of the panels; wherein the lower lip (9) protrudes beyond the free end of the upper lip (8) and the portion of the lower lip (9), which protrudes beyond the free end of the upper lip, has a length (L), as measured according to the direction (H) in the plane of the panel and perpendicular to the edge, which is smaller than the thickness (T) of the floor panel; wherein the coupling parts (4-5) each comprise a locking element (10-11), wherein said locking elements (10-11), in the coupled condition, counteract the moving apart of the tongue and groove in a second direction (H) in the plane of the panels and perpendicular to the coupled edges and thus realize a locking between the coupled panels in the second direction; wherein the locking element (10) of the first coupling part (4) is provided on the lower side of the tongue (6) and the locking element (11) of the second coupling part (5) is provided on the upper side of the lower lip (9) and beyond the free end of the upper lip (8); wherein the coupling parts (4-5) are configured such that the locking elements (10-11) of two of such panels can be brought one behind the other by means of a turning movement (W) of the one panel in respect to the other; wherein the most upward-situated point (P) of the locking element (11) on the lower lip (9) is situated at a distance (D), measured according to the direction perpendicular to the plane of the floor panel, of at least ⅓ times the thickness of the floor panel (T) from the underside (28) of the floor panel (1); and wherein the minimum thickness (T1) of the lower lip (9) is maximum ¼ times the thickness (T) of the floor panel, wherein the lower lip (9) reaches its minimum thickness (T1) between the free end of the upper lip (8) and the locking element (11) on the lower lip.

The second item relates to a floor panel according to item 1, wherein the minimum thickness (T1) of the lower lip (9) is approximately ⅕ of the thickness (T) of the floor panel.

The third item relates to a floor panel according to item 1 or 2, wherein the floor panel (1) has a thickness (T) situated between 9 and 15 millimeters.

The fourth item relates to a floor panel according to any of the previous items 1 to 3, wherein the locking elements (10-11) are manufactured from the material of and in one piece with the actual floor panel (1), more particularly with the material of the core (12) thereof.

The fifth item relates to a floor panel according to any of the previous items 1 to 4, wherein the floor panel comprises a core (12) and a decorative top layer (27) situated above the core.

The sixth item relates to a floor panel according to item 5, wherein the core (12) of the floor panel (1) comprises one of the following materials: wood fiberboard, such as MDF or HDF, or a thermoplastic synthetic material, such as polyvinyl chloride, for example, rigid, semi-rigid or soft PVC, polyethylene and/or polypropylene, or consists of a core composed of a plurality of wooden slats, namely, of a so-called lamellae core, or consists of a plywood core.

The seventh item relates to a floor panel according to any of the previous items 1 to 6, wherein the floor panel (1) shows one or a combination of two or more of the following features:

the feature that one or more pairs of the vertically active locking surfaces (13-14-15-16) are formed at least partially and preferably entirely from the material of the core (12);

the feature that the aforementioned coupling parts (4-5) consist of milled profiles which, for at least 70 percent of their contour, are provided in the material of the core (12);

the feature that the first pair of opposite edges (2-3) as well as the second pair of opposite edges (17-18) is provided with coupling parts (4-5);

the feature that the aforementioned coupling parts (4-5) further allow a coupling by means of a horizontal shifting movement of the edges (2-3) towards each other and/or by means of a downward-directed movement of the first coupling part (4) with said tongue (6) up into the second coupling part (5) with said groove (7);

the feature that in a coupled condition of two of such floor panels 1 a tension force is obtained between the upper edges (19) of the respective floor panels (1); herein, the lower lip (9) preferably is in a bent condition;

the feature that the lower lip (9) in a coupled condition is bent;

the feature that the aforementioned coupling parts (4-5) comprise support portions (20-21), which, in the coupled condition of two of such floor panels (1), cause a fixation in the mutual position of the aforementioned locking elements (10-11), preferably in accordance with U.S. Pat. No. 7,762,036 (incorporated herein by reference). Herein, the support portions (20-21) preferably are situated immediately next to the cooperating portions or horizontally active locking surfaces (22-23) of the locking elements (10-11), namely without an intermediate space. Preferably, the support portions (20-21), in respect to the floor panel (1) with the groove (7), are situated proximally from the aforementioned cooperating portions or horizontally active locking surfaces (22-23) of the locking elements (10-11), although it is not excluded that they might be located distally, that they might be formed, for example, on top of the locking element (11) on the lower lip (9).

The eighth item relates to a floor panel according to any of the previous items 1 to 7, wherein the lower lip, in a coupled condition, is bent and wherein the aforementioned coupling parts comprise support portions, which, in the coupled condition of two of such floor panels, cause a fixation in the mutual position of the aforementioned locking elements, preferably in accordance with U.S. Pat. No. 7,762,036 (incorporated herein by reference).

The ninth item relates to a floor panel according to any of the previous items 1 to 8, wherein in the aforementioned coupled condition a space (S) is formed between the upper surface of the lower lip (9) and the lower side of the tongue (6), at least at the location of the aforementioned minimum thickness of the lower lip (9).

The tenth item relates to a floor panel according to item 9, wherein said space has a maximum height (H), as measured according to the direction (V) perpendicular to the plane of the panel, which is larger, preferably is at least twice as large, as the height (H1) over which the horizontally active locking surfaces (22-23) are extending.

The eleventh item relates to a floor panel according to item 9 or 10, wherein the aforementioned space has a maximum height (H), as measured according to the direction (V) perpendicular to the plane of the panel, which is larger than 0.1 times the thickness (T) of the floor panel (1).

The twelfth item relates to a floor panel according to any of previous items 9 to 11, wherein the aforementioned space has a maximum height (H), as measured according to the direction (V) perpendicular to the plane of the panel, which is situated between 0.75 and 1.5 times the minimum thickness (T1) of the lower lip (9).

The thirteenth item relates to a floor panel according to any of previous items 1 to 12, wherein the locking angle (A) formed by the locking elements (10-11) is situated between 45 and 90 degrees and preferably between 50 and 75 degrees.

The fourteenth item relates to a floor panel according to any of previous items 1 to 13, wherein the coupling parts (4-5) are formed such that, when performing the turning movement (W), a click or snap effect occurs.

The reference numbers mentioned in the aforementioned items are not to be construed as limiting the scope of the items, but are merely used for clarification purposes.

The present invention is in no way limited to the embodiments described herein above, on the contrary may such floor panels be realized according to various variants without leaving the scope of the invention.

The invention claimed is:

1. A floor panel for forming a floor covering, comprising a first edge with a first coupling part and a second, opposite edge with a second coupling part, wherein the aforementioned coupling parts are configured such that they allow coupling two of such floor panels to each other and realizing a coupled condition of two of such floor panels on the respective edge;

wherein the first coupling part is realized in the form of a tongue and the second coupling part is realized in the form of a groove, wherein said groove is bordered by an upper lip and a lower lip, wherein said tongue and groove, in coupled condition, form a tongue and groove connection which, at the respective edge, forms a locking between the coupled panels in a first direction perpendicular to the plane of the panels;

wherein the lower lip protrudes beyond the free end of the upper lip and the portion of the lower lip, which protrudes beyond the free end of the upper lip, has a length, as measured according to the direction in the plane of the panel and perpendicular to the edge, which is smaller than the thickness of the floor panel;

wherein the coupling parts each comprise a locking element, wherein said locking elements, in the coupled condition, counteract the moving apart of the tongue and groove in a second direction in the plane of the panels and perpendicular to the coupled edges and thus realize a locking between the coupled panels in the second direction;

wherein the locking element of the first coupling part is provided on the lower side of the tongue and the locking element of the second coupling part is provided on the upper side of the lower lip and beyond the free end of the upper lip;

wherein the coupling parts are configured such that the locking elements of two of such panels can be brought one behind the other by means of a turning movement of the one panel in respect to the other;

wherein the most upward-situated point of the locking element on the lower lip is situated at a distance, measured according to the direction perpendicular to the plane of the floor panel, of at least ⅓ times the thickness of the floor panel from the underside of the floor panel;

and wherein the minimum thickness of the lower lip is maximum ¼ times the thickness of the floor panel, wherein the lower lip reaches its minimum thickness between the free end of the upper lip and the locking element on the lower lip;

wherein in the coupled condition a space is arranged to be formed between the upper surface of the lower lip and the lower side of the tongue, at least at the location of the aforementioned minimum thickness of the lower lip;

wherein said space has a maximum height, as measured according to the direction perpendicular to the plane of the panel, which is larger as the height over which horizontally active locking surfaces extend;

wherein the maximum height of the space, as measured according to the direction perpendicular to the plane of the panel, is situated between 0.75 and 1.5 times the minimum thickness of the lower lip.

2. The floor panel of claim 1, wherein the minimum thickness of the lower lip is approximately ⅕ of the thickness of the floor panel.

3. The floor panel of claim 1, wherein the floor panel has a thickness situated between 9 and 15 millimeters.

4. The floor panel of claim 1, wherein the locking elements are manufactured from the material of and in one piece with the actual floor panel.

5. The floor panel of claim 1, wherein the floor panel comprises a core and a decorative top layer situated above the core.

6. The floor panel of claim 5, wherein the core of the floor panel comprises one of the following materials: wood fiberboard or a thermoplastic synthetic material; or consists of a core composed of a plurality of wooden slats; or consists of a plywood core.

7. The floor panel of claim 5, wherein the floor panel shows one or a combination of two or more of the following characteristics:

the characteristic that one or more pairs of vertically active locking surfaces are formed at least partially from the material of the core;

the characteristic that the aforementioned coupling parts consist of milled profiles which, for at least 70 percent of their contour, are provided in the material of the core;

the characteristic that the first pair of opposite edges as well as the second pair of opposite edges is provided with coupling parts;

the characteristic that the aforementioned coupling parts further allow a coupling by means of a horizontal shifting movement of the edges towards each other and/or by means of a downward-directed movement of the first coupling part with said tongue up into the second coupling part with said groove;

the characteristic that in a coupled condition of two of such floor panels a tension force is obtained between the upper edges of the respective floor panels;

the characteristic that the lower lip in a coupled condition is bent;

the characteristic that the aforementioned coupling parts comprise support portions, which, in the coupled condition of two of such floor panels, cause a fixation in the mutual position of the aforementioned locking elements;

the characteristic that the support portions are situated immediately next to cooperating portions or horizontally active locking surfaces of the locking elements without an intermediate space;

the characteristic that the support portions, in respect to the floor panel with the groove, are situated proximally from the aforementioned cooperating portions or horizontally active locking surfaces of the locking elements.

8. The floor panel of claim 1, wherein the lower lip, in a coupled condition, is bent and wherein the aforementioned coupling parts comprise support portions, which, in the coupled condition of two of such floor panels, cause a fixation in the mutual position of the aforementioned locking elements.

9. The floor panel of claim 1, wherein the maximum height of the space, is at least twice as large as the height of the horizontally active locking surfaces.

10. The floor panel of claim 1, wherein the maximum height of the space, as measured according to the direction perpendicular to the plane of the panel, is larger than 0.1 times the thickness of the floor panel.

11. The floor panel of claim 1, wherein the locking angle formed by the locking elements is situated between 45 and 90 degrees.

12. The floor panel of claim 1, wherein the coupling parts are formed such that, when performing the turning movement, a click or snap effect occurs.

13. First and second floor panels for forming a floor covering, each of said first and second floor panels comprising a first edge with a first coupling part and a second, opposite edge with a second coupling part, wherein the coupling parts are configured such that they allow coupling of the first and second floor panels with the first coupling part of the first panel to the second coupling part of the second panel;

wherein the first coupling part is realized in the form of a tongue and the second coupling part is realized in the form of a groove, wherein said groove is bordered by an upper lip and a lower lip, wherein said tongue and groove, in coupled condition, form a tongue and groove connection which, at the respective edge, forms a locking between the coupled panels in a first direction perpendicular to the plane of the panels;

wherein the lower lip protrudes beyond the free end of the upper lip and the portion of the lower lip, which protrudes beyond the free end of the upper lip, has a length, as measured according to the direction in the plane of the panel and perpendicular to the edge, which is smaller than the thickness of the floor panel;

wherein the coupling parts each comprise a locking element, wherein said locking elements, in the coupled condition, counteract the moving apart of the tongue and groove in a second direction in the plane of the panels and perpendicular to the coupled edges and thus realize a locking between the coupled panels in the second direction;

wherein the locking element of the first coupling part is provided on the lower side of the tongue and the locking element of the second coupling part is provided on the upper side of the lower lip and beyond the free end of the upper lip;

wherein the coupling parts are configured such that the locking elements of two of such panels can be brought one behind the other by means of a turning movement of the one panel in respect to the other;

wherein the most upward-situated point of the locking element on the lower lip is situated at a distance, measured according to the direction perpendicular to the plane of the floor panel, of at least ⅓ times the thickness of the floor panel from the underside of the floor panel;

and wherein the minimum thickness of the lower lip is maximum ¼ times the thickness of the floor panel, wherein the lower lip reaches its minimum thickness between the free end of the upper lip and the locking element on the lower lip;

wherein in the coupled condition a space is formed between the upper surface of the lower lip of the second panel and the lower side of the tongue of the first panel, at least at the location of the minimum thickness of the lower lip;

wherein said space has a maximum height, as measured according to the direction perpendicular to the plane of the panel, which is larger as the height over which horizontally active locking surfaces extend;

wherein the maximum height of the space, as measured according to the direction perpendicular to the plane of the panel, is situated between 0.75 and 1.5 times the minimum thickness of the lower lip.

14. The floor panel of claim 13, wherein the maximum height of the space is at least twice as large as the height of the horizontally active locking surfaces.

15. The floor panel of claim 13, wherein the maximum height of the space, as measured according to the direction perpendicular to the plane of the panel, is larger than 0.1 times the thickness of the floor panel.

16. A floor panel for forming a floor covering, comprising a first edge with a first coupling part and a second, opposite edge with a second coupling part, wherein the aforementioned coupling parts are configured such that they allow coupling two of such floor panels to each other and realizing a coupled condition of two of such floor panels on the respective edge;

wherein the first coupling part is realized in the form of a tongue and the second coupling part is realized in the form of a groove, wherein said groove is bordered by an upper lip and a lower lip, wherein said tongue and groove, in coupled condition, form a tongue and groove connection which, at the respective edge, forms a locking between the coupled panels in a first direction perpendicular to the plane of the panels;

wherein the lower lip protrudes beyond the free end of the upper lip and the portion of the lower lip, which protrudes beyond the free end of the upper lip, has a length, as measured according to the direction in the plane of the panel and perpendicular to the edge, which is smaller than the thickness of the floor panel;

wherein the coupling parts each comprise a locking element, wherein said locking elements, in the coupled condition, counteract the moving apart of the tongue and groove in a second direction in the plane of the panels and perpendicular to the coupled edges and thus realize a locking between the coupled panels in the second direction;

wherein the locking element of the first coupling part is provided on the lower side of the tongue and the locking element of the second coupling part is provided on the upper side of the lower lip and beyond the free end of the upper lip;

wherein the coupling parts are configured such that the locking elements of two of such panels can be brought one behind the other by means of a turning movement of the one panel in respect to the other;

wherein the most upward-situated point of the locking element on the lower lip is situated at a distance, measured according to the direction perpendicular to the plane of the floor panel, of at least ⅓ times the thickness of the floor panel from the underside of the floor panel;

and wherein the minimum thickness of the lower lip is maximum ¼ times the thickness of the floor panel, wherein the lower lip reaches its minimum thickness between the free end of the upper lip and the locking element on the lower lip;

wherein in the coupled condition a space is arranged to be formed between the upper surface of the lower lip and the lower side of the tongue, at least at the location of the aforementioned minimum thickness of the lower lip;

wherein said space has a maximum height, as measured according to the direction perpendicular to the plane of the panel, which is larger as the height over which horizontally active locking surfaces extend;

wherein an upper surface of the space is one or a combination of flat or continuously declining in a direction towards a distal end of the tongue.

17. The floor panel of claim 16, wherein the space is defined by the upper surface of the space, a lower surface of the space, and first and second inclined surfaces extending between the upper and lower surfaces of the space, the first inclined surface located more distant from the locking element than the second inclined surface;

wherein the lower surface of the space is substantially parallel with a bottom surface of the floor panel, the first inclined surface declines toward the locking element, and the second inclined surface inclines toward the locking element.

* * * * *